US005426912A

United States Patent [19]

Hall et al.

[11] Patent Number: 5,426,912

[45] Date of Patent: Jun. 27, 1995

[54] MAGNETIC CAP GUIDE

[75] Inventors: Nick E. Hall, Tinley Park, Ill.; Karl Kaul, Van Buren, Ark.

[73] Assignee: Continental White Cap, Inc., Northbrook, Ill.

[21] Appl. No.: 173,705

[22] Filed: Dec. 23, 1993

Related U.S. Application Data

[63] Continuation of Ser. No. 968,232, Oct. 29, 1992, which is a continuation of Ser. No. 607,027, Oct. 31, 1990, abandoned.

[51] Int. Cl.[6] ..... B65B 7/28

[52] U.S. Cl. ..... 53/314; 53/313; 53/315

[58] Field of Search ..... 53/313, 314, 315, 316

[56] References Cited

U.S. PATENT DOCUMENTS

| | | | |
|---|---|---|---|
| 2,522,437 | 9/1950 | Enkur | 53/314 |
| 2,618,426 | 11/1952 | Stover | 53/215 |
| 2,630,959 | 3/1953 | Brown | 53/315 |
| 2,951,327 | 9/1960 | Fauth | 53/315 |
| 3,012,388 | 12/1961 | Stover | 53/315 |
| 3,054,234 | 9/1962 | Stover | 53/315 |
| 3,071,909 | 1/1963 | Elleman | 53/315 |
| 3,274,748 | 9/1966 | Roberts et al. | 53/315 |
| 3,280,534 | 10/1966 | Hildebrandt et al. | 53/315 |
| 3,438,174 | 4/1969 | Foss et al. | 53/314 |
| 3,460,312 | 8/1969 | Stover | 53/315 |
| 3,477,202 | 11/1969 | Zetterberg | 53/315 |
| 3,800,501 | 4/1974 | Raatz et al. | 53/315 |
| 3,874,147 | 4/1975 | Zetterberg | 53/315 X |

*Primary Examiner*—John Sipos
*Assistant Examiner*—Daniel Moon
*Attorney, Agent, or Firm*—Lockwood, Alex, Fitzgibbon & Cummings

[57] ABSTRACT

This relates to a guide for guiding a closure cap onto a container neck finish in a machine for automatically applying closure caps to containers. Most particularly this relates to a guide assembly for closure caps which include a metal shell and a plastic overcap including a tamper indicating band which depends below the metal shell and wherein the closure cap cannot be supported by way of flanges or rails of a track in the normal manner in that the supporting part of the closure cap is subject to deformation and not true and round as in the case of metal closure caps. A lower portion of the conventional track has been replaced by a magnetic cap guide unit which forms an extension of the conventional track and which maintains the position of a closure cap after it has been initially engaged by the neck finish of a container so as to maintain the relationship of the closure cap relative to the container which permits the closure cap being seated square on to the neck finish for final automatic application.

24 Claims, 4 Drawing Sheets

MAGNETIC CAP GUIDE

This application is a continuation of application Ser. No. 07/968,232, filed Oct. 29, 1992 which is a continuation of application Ser. No. 07/607,027, filed Oct. 31, 1990 now abandoned.

This invention relates in general to new and useful improvements in apparatus for applying caps to containers, and more particularly to an improved cap guide.

In the past, metal and rigid plastic caps have been directed down a supporting chute to a position wherein each cap is engaged by a container passing therebeneath followed either by the pressing down of the cap on to the threaded neck finish of the container, or the passage of the cap between belts which would serve to rotate the cap and thread it onto the container. As long as the caps were of a rigid construction, their cross section remained cylindrical and the diameter dimension remained constant. Thus they could be supported by lips or flanges of the track.

However, more recently, the customary metal caps have been provided with a plastic overcap with a depending tamper indicating band that is quite flexible and which, prior to the application thereof to a container, may not be cylindrical. As a result, these closure caps frequently either fall through the track or become jammed therein. With respect to this, it is to be understood that the supporting lips or flanges of the track, in the area where the closure cap is transferred to a container, must provide for a minimal support area so that the cap may be pulled through.

In accordance with this invention, it is proposed to eliminate a lower portion of the track for the closure cap and to substitute therefor a magnetic cap guide which will support the closure cap solely by the attraction of the metal shell thereof to an overlying magnet so that the closure cap is supported solely by the magnet as it is moved along the path of transfer by a container engaged therewith.

With the above and other objects in view that will hereinafter appear, the nature of the invention will be more clearly understood by reference to the following detailed description, the appended claims, and the several views illustrated in the accompanying drawings.

DETAILED DESCRIPTION

Figure 2:
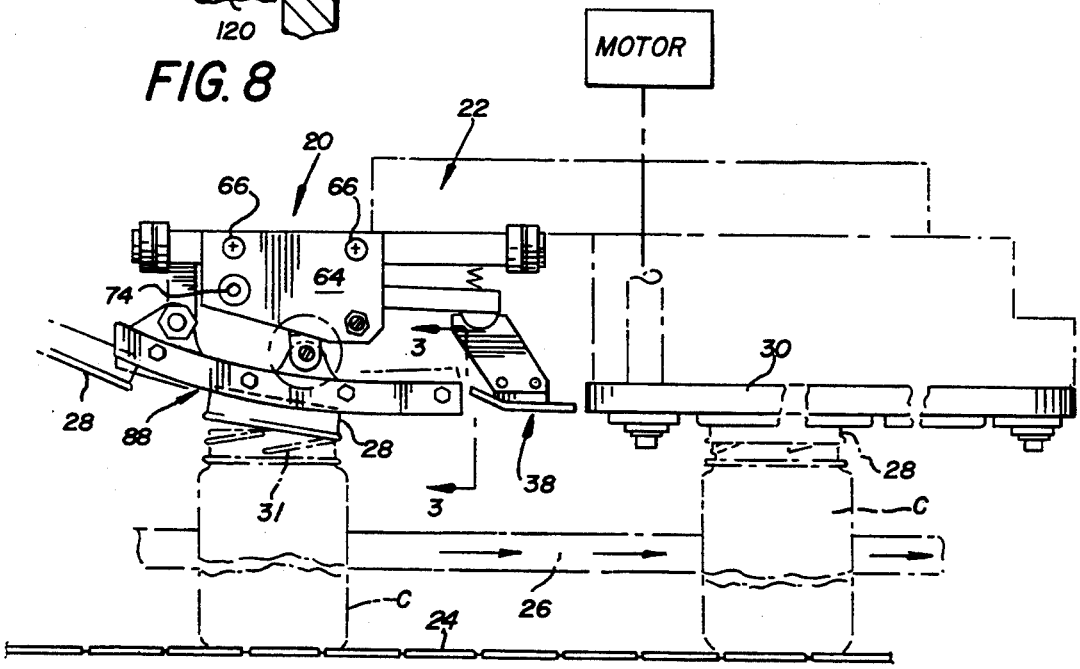
FIG. 2 is a side elevtional view of the cap guide unit of FIG. 1 showing it in place in a cap application mechanism.
Figure 4:
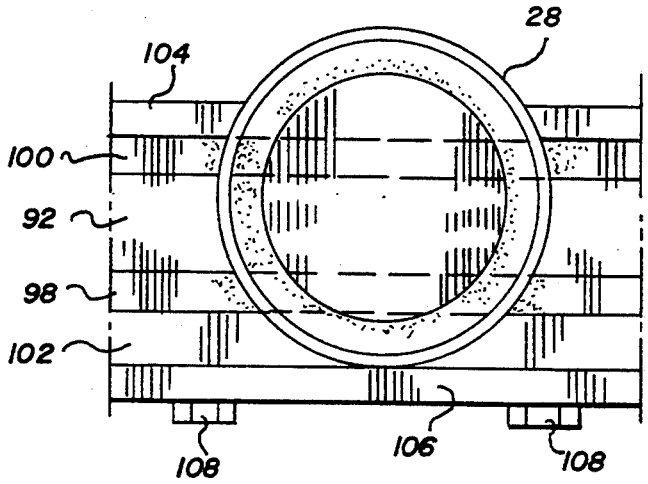
FIG. 4 is an enlarged fragmentary bottom plan view showing the relationship of a cap with respect to a forward portion of the guide.
Figure 6:
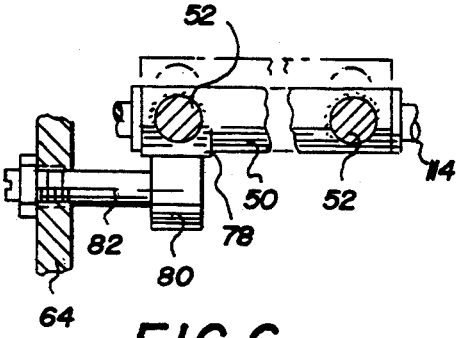
FIG. 6 is a fragmentary vertical sectional view taken generally along the line 6—6 of FIG. 5 and shows the manner in which a support for the duck bill is vertically adjusted.
Figure 3:
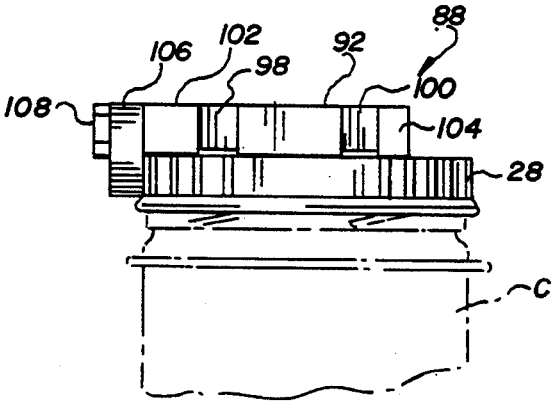
FIG. 3 is an enlarged fragmentary transverse vertical sectional view taken generally along the line 3—3 of FIG. 2 and shows the manner in which a cap is guided in accordance with this invention.

Referring now to the drawings in detail, reference is first made to FIG. 2 which shows the magnetic cap guide assembly, generally identified by the numeral 20 in position in a cap applying machine, generally identified by the numeral 22. The machine 22 basically includes a conveyor 24 for conveying containers C along a predetermined path with the containers C being guided along that path by suitable guides 26. Closure caps 28 are delivered in sequence by way of a chute (not shown) which slopes downwardly and to the right with a closure cap 28 just leaving such chute. The prior art chute has opposed lips or flanges on which a closure cap 28 is seated and these lips or flanges decrease in effective support as the closure cap 28 reaches a position where it is engaged by a container C.

Finally, these lips or flanges become so spaced as to permit a container C to draw a closure cap 28 down from the chute. With the closure cap 28 properly seated on a container C, the closure cap 28 passes between a pair of belts 30 which have runs thereof disposed in slightly converging spaced relation for engaging and twisting a closure cap 28 to thread the same on to a neck finish 31 of such container.

In accordance with this invention, a lower portion of the cap delivery chute is eliminated and is replaced by a magnetic cap guide unit 20. The magnetic cap guide unit 20 will now be described in detail with particular reference to FIG. 7.

Figure 7:
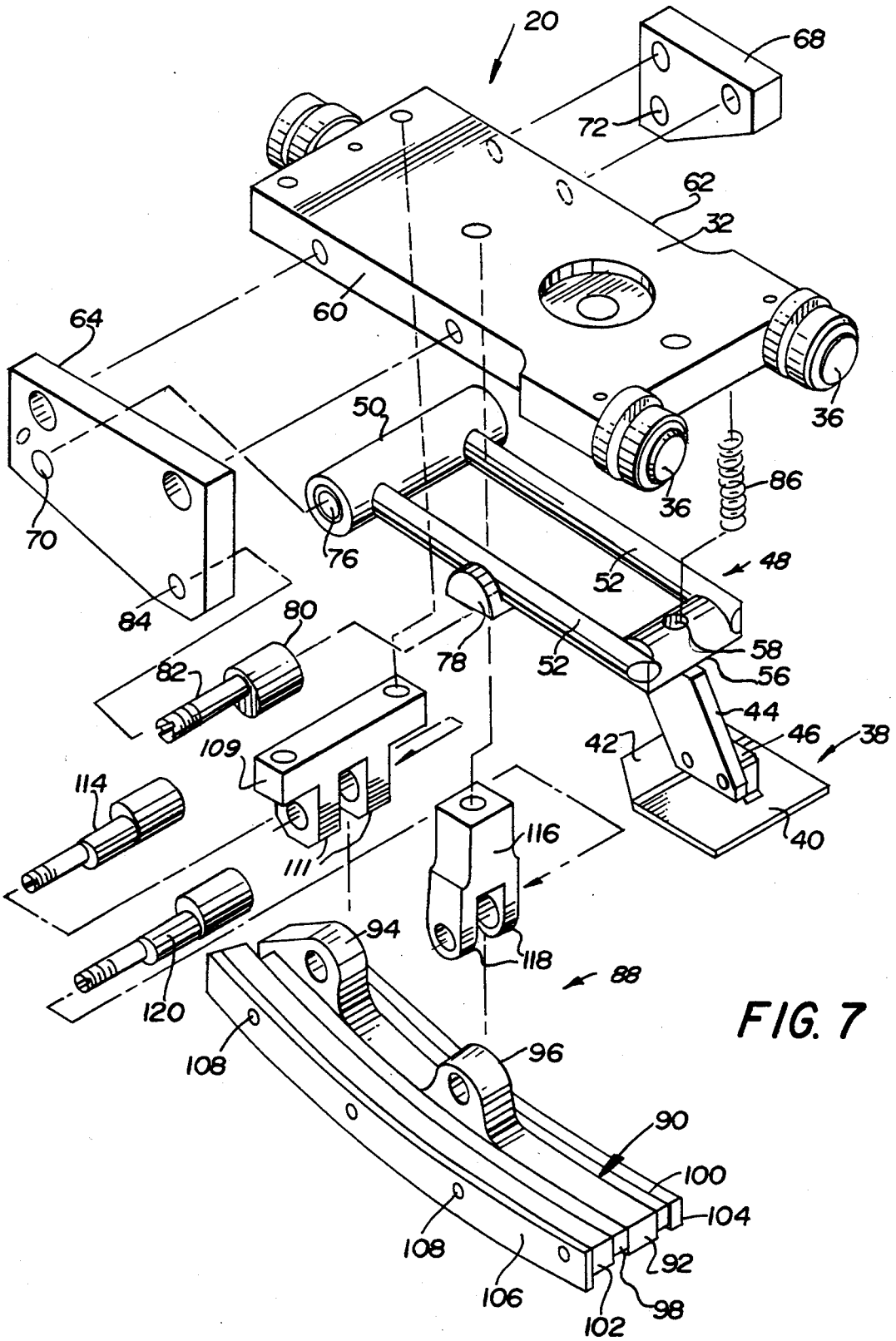
FIG. 7 is an exploded perspective view of the magnetic cap guide unit of FIG. 1 and shows the details of construction thereof.

FIG. 7 shows the magnetic cap guide unit 20 as including an upper mounting plate 32 which is provided at the left end thereof with a centrally located support 34 and at the right end thereof, at opposite corners of the plate 32, with like supports 36. These supports are engaged in a known manner with support structure of the closure cap applying mechanism 22.

First of all, the magnetic cap guide unit 20 includes a forwardly located duck bill or hold down 38 which includes a flat plate portion 40 having at the rear thereof an upwardly and rearwardly sloping plate portion 42. The duck bill 38 is carried by a depending plate or arm 44 which is fixedly secured to an upstanding member 46 rigid with the duck bill 38.

The plate 44 is carried by a support unit generally identified by the numeral 48. The support unit 48 includes a rearmost transversely extending tubular member 50 which has extending forwardly therefrom a pair of transversely spaced, parallel arms or support elements 52. The arms 52 are joined at their forward end by a transverse member 56 to which the plate 44 is fixedly secured. The transverse member is provided in the extreme top thereof with a centrally located partial bore 58 for a purpose to be described in detail hereinafter.

Figure 1:
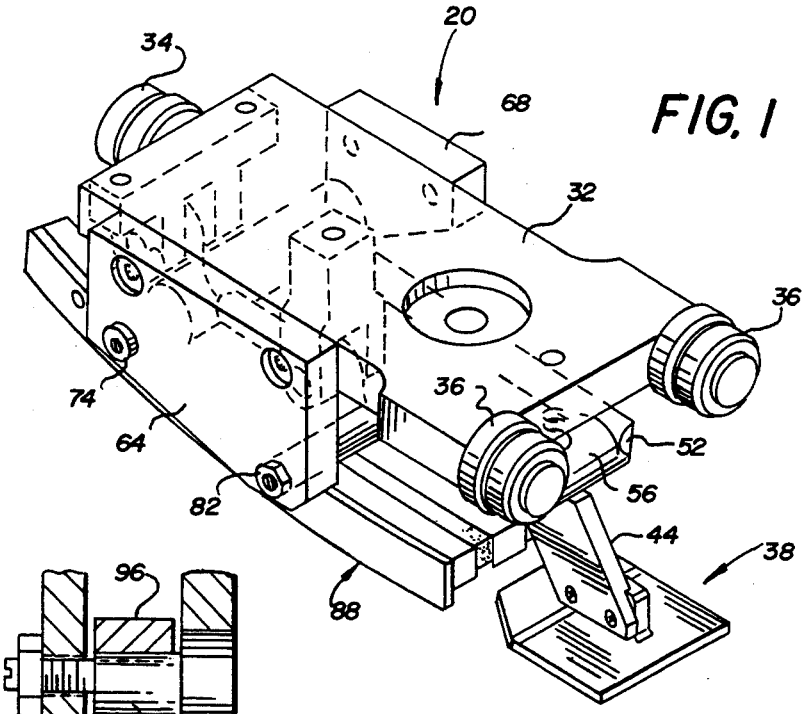
FIG. 1 is a top perspective view of a cap guide unit formed in accordance with this invention.

The plate 32 has opposite flat side edge portions 60, 62 in the rear part thereof. To the side edge portion 60 there is attached a depending plate 64 by way of a pair of countersunk fasteners 66 (FIG. 2). In a like manner, a depending plate 68 is secured to the side edge 62 in depending relation. The plates 64, 68 have transversely aligned bores 70, 72. A support shaft 74 (FIG. 1) extends through the bores 70, 72 and is supported by the plates 64, 68. The support shaft 74 also passes through a bushing 76 in the element 50.

The arm 52 adjacent the plate 64 is provided in the central portion thereof with a support element 78 which rests upon an eccentric 80 of an eccentric shaft 82. The shaft 82 is -engaged in a bore 84 in the forward bottom corner of the plate 64 and by selectively positioning the eccentric 80, raises and lowers the forward end of the support 48.

In order that the element 78 may always be held tightly against the eccentric 80, there is mounted in the bore 58 a lower end of a compression spring 86, which, in turn, is seated in a suitable bore (not shown) in the underside of the plate 32.

From the foregoing, it will be readily apparent how the duck bill 38 may be adjusted as to position.

A principal feature of the invention is a closure cap magnetic guide assembly 88 which is best shown in FIG. 7. The closure cap magnetic guide assembly 88 includes a combined central support and main frame member generally identified by the numeral 90 and including an elongated curved bar 92 having two upstanding support portions 94, 96. The central support and main frame member 90 is preferably formed of a non-magnetic material.

On opposite sides of the bar 92 there is clamped elongated magnets 98, 100 by way of rails 102, 104, respectively. Further, there is clamped against the rail 102 a curved guide 106. The elements of the closure cap magnetic guide assembly 88 are secured together by means of suitable fasteners 108.

At this time it is pointed out that the curved underside of the support member 90 also functions as a rail with the rails 102, 104 being preferably formed of a non-magnetic material. It is also to be seen that the magnets 98, 100 are recessed upwardly above the cap engaging lower surfaces of the rails 102, 104 as well as the bar 92.

In order to suspend the magnetic cap guide assembly 88 from the plate 32, there is secured to the underside of the plate 32 at the rear thereof a yoke 109 including a pair of depending brackets 111. The brackets 111 have received therebetween the element 94 with the element 94 being supported by way of a transverse shaft 114 which is illustrated in FIG. 7.

Figure 8:
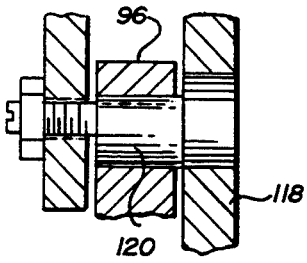
FIG. 8 is a fragmentary transverse vertical sectional view showing the manner in which a support member of a magnetic cap guide assembly is mounted.

There is also secured to the underside of the plate 32 a forward yoke 116 having a pair of depending fingers 118. The forward member 96 of the support 90 is positioned between the fingers 118 and is carried by a shaft, such as the shaft 120 as is clearly shown in FIG. 8.

In operation, with the house of the magnetic cap guide assembly 88 and the duck bill 38 properly adjusted, as the closure cap 28 passes from the usual supply chute and is engaged by the neck finish 31 of a container C, the closure cap will be moved forwardly as is best shown in FIG. 2. At this time the closure cap 28 will be slightly cocked or at an angle with respect to the container C. However, that angle will change as the closure cap 28 passes around the curvature of the magnetic cap guide assembly 88. The duck bill 38 will engage the closure cap 28 to make certain that it is square on the container C before the closure cap 28 passes between the belts 30.

Figure 9:
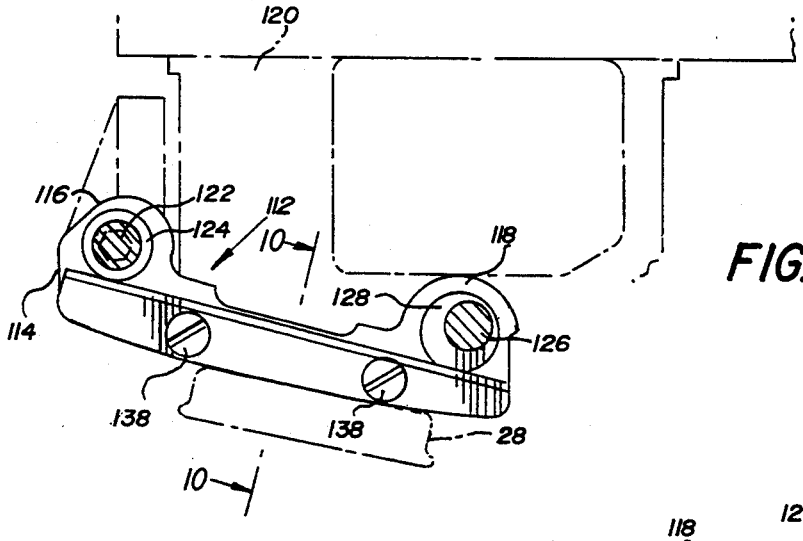
FIG. 9 is a side elevational view with parts broken away of a modified form of magnetic cap guide assembly.
Figure 10:
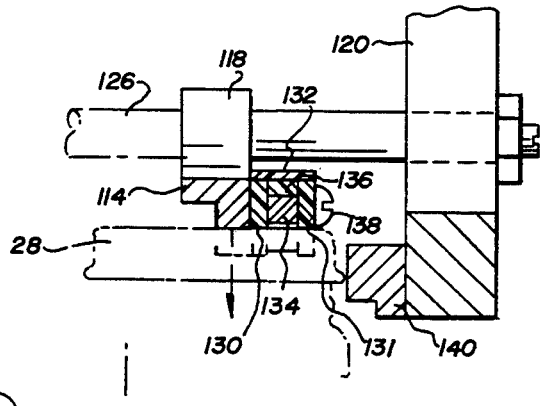
FIG. 10 is a fragmentary transverse vertical sectional view taken generally along the line 10—10 of FIG. 9 and shows the specific details of the magnetic cap guide assembly and the mounting thereof.

Reference is now made to FIGS. 9 and 10 wherein there is illustrated a slightly modified form of a magnetic cap guide assembly, generally identified by the numeral 112. The magnetic cap guide assembly 112 includes an elongated support member in the form of an elongated bar 114 and having projecting upwardly therefrom at opposite ends hubs 116, 118.

The support member 114 is carried by a suitable fixture 120, not shown in detail, with a shaft 122 which is mounted for limited rotation within the fixture 120 and which passes through a bushing 124 in the hub 116.

The forward end of the magnetic cap guide 112 is also supported from the fixture 120 by means of a shaft 126 which carries an eccentric bushing 128 journalled in the hub 118. By rotating the shaft 126, the magnetic cap guide 112 may be vertically adjusted as required. The bar 114 has secured to one side thereof, as shown in FIG. 10, a vertical rail 130 which is preferably formed of a non-magnetic material. A top plate 132 is mounted on the vertical rail 130 and carries a second vertical rail 131. An insert 136 is mounted on the underside of the top plate 132 between the rails 130 and 131. A plurality of magnets 134 (one shown) are mounted on the underside of insert 136. The bottom ends of the magnets 134 terminate above the bottom edges of the rails 130–131. Thus a closure cap 28 will be held up against the bottom of the rail 130 as well as the bottom of the bar 114. Preferably the surfaces of the bar 114 and the rail 130 will be longitudinally curved as is generally shown in FIG. 9.

As is clearly shown in FIGS. 9 and 10, the rails 130 and 131 and the magnets 134 as well as the top plate 132 and insert 136 will be mounted on the side of the bar 114 as a unit utilizing suitable fasteners 138.

Referring once again to FIG. 10, it will be seen that the fixture 120 further includes a pair of opposed closure cap side guides 140 of which only one has been specifically illustrated. In this manner a closure cap 28 has the path thereof determined by the guides 140 as well as by the rail 130.

Figure 11:
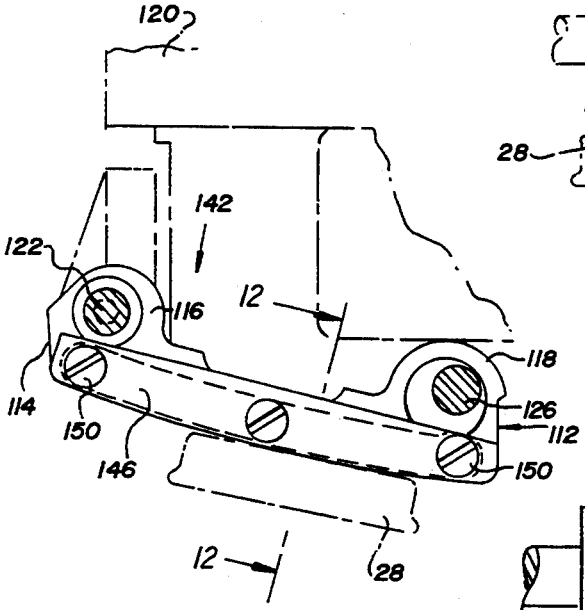
FIG. 11 is a side elevational view with parts broken away of another modified form of magnetic cap guide assembly.
Figure 12:
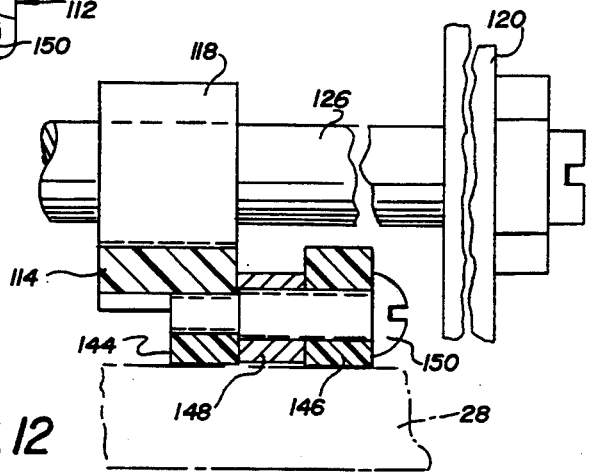
FIG. 12 is a fragmentary transverse vertical sectional view taken generally along the line 12—12 of FIG. 11 and shows the specific details of the magnetic cap guide assembly and the mounting thereof.

Reference is now made to FIG. 11 wherein there is illustrated another form of a magnetic cap guide assembly generally identified by the numeral 142. The assembly 142 includes the support member 112 formed of the bar 114 having the upstanding hubs 116, 118. The support member 112 is again supported by a shaft 122 passing through the hub 116 and the shaft 126 passing through the hub 118. However, the mounting of a magnet is different as is best shown in FIG. 12. An offset lower part 144 of the bar 114 functions as one rail with there being a second rail 146 spaced from the part 144 by way of an elongated magnet 148. The rail 146 and the magnet 148 are secured in place on the bar 114 by a suitable fastener 150. Once again the magnet 148 is recessed relative to the rails 144 and 146.

It is to be understood that the mechanism shown in FIGS. 11 and 12 will incorporate the side guides 140 although they have not been shown for simplicity purposes.

Figure 5:
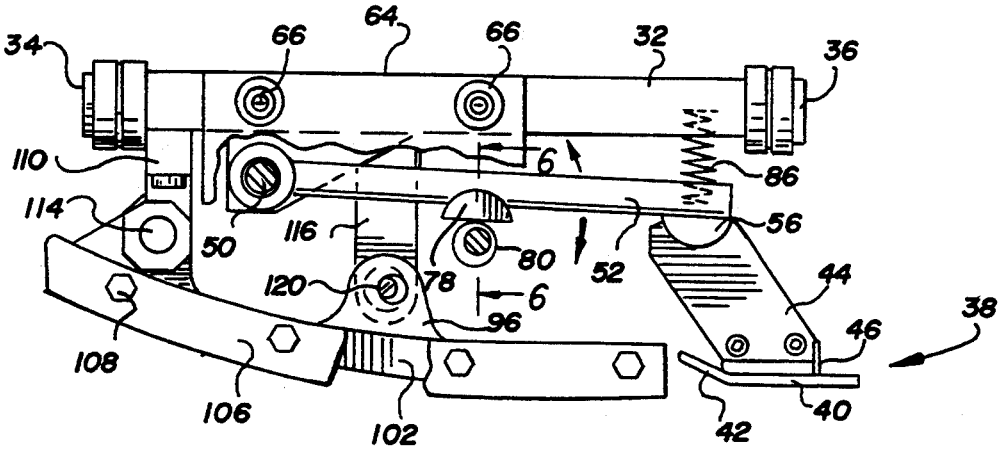
FIG. 5 is a side elevational view of the cap guide unit with parts broken away so as to specifically illustrate details of the unit and most particularly the mounting of a forward duck bill or hold down.

It is also to be understood that while the fixture 120 may be different from the support structure of the magnetic cap guide unit 30, there will be associated with the magnetic cap guide assemblies 112 and 142 a duck bill such as the duck bill 38 (FIGS. 1 and 5) which may be adjustably mounted in any desired manner including that illustrated in FIG. 7.

The magnetic cap guide assembly can include a rail having a plurality of individual magnets recessed therein. For example, the rail can have bores extending down from a top wall thereof with said bores terminating in said rail in spaced relation from a bottom wall of said rail, and said magnets are seated in said bores. A coverplate can overlie said rail and retain said magnets in said bores.

Although only several preferred embodiments of magnetic cap guide assemblies have been specifically illustrated and described herein, it is to be understood that minor variations may be made therein without departing from the spirit and scope of the invention as defined by the appended claims.

We claim:

1. Apparatus for applying closure caps of the type having at least a metal shell to containers, said apparatus having a feed end and a discharge end including in series and spaced one after the other from feed end to discharge end, a flanged track for conveying caps, an elongated magnetic cap guide assembly, and a separate cap hold down; said cap guide assembly comprising a magnetic cap guide member positioned between said flanged track for conveying caps and separate cap hold down; said magnetic cap guide member including a main frame member supported by at least one transverse shaft, at least one rail extending substantially the full length of said magnetic guide member and having a curved cap-contacting surface and at least one elongate magnet positioned between said rail and main frame member in recessed relation to said rail; said magnetic guide member forming a sole vertical support for a cap at such time as a cap is engaged by a container after leaving said flanged track and being positioned to engage the front end of the cap with the front end of the container at an engagement angle formed by the cap and the container.

2. The apparatus according to claim 1 wherein said cap guide assembly defines a curved cap path for all or most of its length.

3. The apparatus of claim 1 wherein said magnetic cap guide assembly includes a pair of spaced rails extending substantially the full length of said magnetic guide assembly, and said at least one magnet is positioned between said rails in recessed relation therewith, whereby said magnet holds a cap against said rails for sliding movement along and against said rails.

4. The apparatus according to claim 3 wherein said magnetic cap guide assembly defines a curved cap path for all or most of its length.

5. The apparatus according to claim 3 wherein a cap side guide is clamped against one of said rails transversely outwardly of said one rail.

6. The apparatus according to claim 3 wherein said cap guide assembly includes a main frame member supported by two transverse shafts.

7. The apparatus according to claim 6 wherein said main frame member forms one of said rails.

8. The apparatus according to claim 7 wherein one of said rails clamps said magnet transversely against said frame member.

9. The apparatus according to claim 1 wherein said cap guide assembly includes a main frame member supported by two transverse shafts.

10. The apparatus according to claim 9 wherein said assembly includes a pair of spaced rails, said shafts are carried by a support, and said support carries side guides for caps in opposed relation spaced below said rails.

11. The apparatus according to claim 9 wherein there are two elongated magnets, one on each side of said frame member.

12. The apparatus according to claim 11 wherein there is an outer rail on each side of said frame member with one of said magnets therebetween.

13. The apparatus according to claim 12 wherein a cap side guide is clamped to one of said outer rails transversely outwardly of said one outer rail and depending below said one outer rail.

14. The apparatus according to claim 1 wherein there is a mounting plate carrying said magnetic cap guide assembly and there is a separate support for the said cap hold down carried by said mounting plate.

15. The apparatus according to claim 14 wherein transverse supporting shafts for said hold down are carried by side plates secured to opposite longitudinal edges of said mounting plate.

16. The apparatus according to claim 14 wherein said separate support includes transversely spaced, support members, and said magnetic cap guide assembly is carried by yokes depending from said mounting plate.

17. The apparatus according to claim 14 wherein said separate support is pivotally mounted adjacent one end, resiliently urged downwardly adjacent an opposite end, and vertically adjustably supported intermediate said ends.

18. The apparatus according to claim 1 wherein said cap guide assembly includes a rail having a plurality of individual magnets recessed therein.

19. The apparatus according to claim 18 wherein said rail has bores terminating in said rail in spaced relation from the surface of said rail, and said magnets are seated in said bores.

20. The apparatus according to claim 19 wherein a cover plate overlies said rail and retains said magnets in said bores.

21. Apparatus for applying closure caps of the type having at least a metal shell to containers, said apparatus having a feed end and a discharge end including in series and spaced one after the other from feed end to discharge end, a flanged track for conveying caps, an elongated magnetic cap guide assembly, and a separate cap hold down; said cap guide assembly comprising a magnetic guide member particularly adapted to be positioned between said flanged track for conveying caps and separate cap hold down; said magnetic guide member including a main frame member supported by at least one transverse shaft, at least two spaced rails extending substantially the full length of said magnetic guide member, and at least one elongate magnet positioned between said rails and in recessed relationship therewith, said main frame member forming one of said rails, said magnetic guide member forming a sole vertical support for a cap at such time as a cap is engaged by a container after leaving said flanged track and being positioned to engage the front end of the cap with the front end of the container at an engagement angle formed by the cap and the container; whereby, said at least one elongate magnet holds a cap for sliding movement along said rails.

22. The apparatus of claim 21 wherein one of said rails clamps said elongate magnet transversely against said frame member.

23. Apparatus for applying closure caps of the type having at least a metal shell to containers, said apparatus having a feed end and a discharge end and including, in series and spaced one after the other from feed end to discharge end, a flanged track for conveying caps, an elongated magnetic cap guide assembly, and a separate cap hold down; said cap guide assembly comprising a magnetic guide member particularly adapted to be positioned between said flanged track for conveying caps and separate cap hold down, said magnetic cap guide member including a main frame member supported by at least one transverse shaft, at least two spaced rails extending the full length of said magnetic guide member, and a pair of elongate magnets on opposite sides of said main frame member in recessed relation to said rails, said magnetic guide member forming a sole vertical support for a cap at such time as a cap is engaged by a container after leaving said flanged cap conveying track and being positioned to engage the front end of the cap with the front end of the container at an engagement angle formed by the cap and the container; whereby said pair of elongate magnets hold a cap for sliding movement along said rails.

24. The apparatus according to claim 23 wherein one of each of said rails is on an opposite side of said frame member and one of each of said pair of magnets is positioned between one of said rails and said frame member.

* * * * *